United States Patent [19]

Oguro

[11] 4,230,968

[45] Oct. 28, 1980

[54] CATHODE STRUCTURE FOR MAGNETRONS

[75] Inventor: Tomokatsu Oguro, Mobara, Japan

[73] Assignee: Hitachi, Ltd., Tokyo, Japan

[21] Appl. No.: 10,311

[22] Filed: Feb. 7, 1979

Related U.S. Application Data

[63] Continuation of Ser. No. 799,546, May 23, 1977.

[30] Foreign Application Priority Data

| | | | |
|---|---|---|---|
| May 26, 1976 | [JP] | Japan | 51-60048 |
| Jun. 2, 1976 | [JP] | Japan | 51-63601 |
| Jun. 25, 1976 | [JP] | Japan | 51-74370 |

[51] Int. Cl.[2] ..... H01J 25/50

[52] U.S. Cl. ..... 315/39.51; 313/341; 313/348

[58] Field of Search ..... 313/341, 348, 349; 315/39.51

[56] References Cited

U.S. PATENT DOCUMENTS

| | | | |
|---|---|---|---|
| 1,889,612 | 11/1932 | Perrott | 313/341 X |
| 1,913,427 | 6/1933 | Bond | 313/341 X |
| 2,212,827 | 8/1940 | Etzrodt | 313/341 X |
| 2,468,736 | 5/1949 | Buter | 313/341 |
| 3,800,378 | 4/1974 | Lee et al. | 313/348 |

*Primary Examiner*—Saxfield Chatmon, Jr.
*Attorney, Agent, or Firm*—Charles E. Pfund

[57] ABSTRACT

The cathode filament of a magnetron is constituted by a metallic cylindrical body provided with a plurality of perforations. The cylindrical body may be made of a cylinder or formed by helically winding a web of a metal strip.

15 Claims, 21 Drawing Figures

CATHODE STRUCTURE FOR MAGNETRONS

This is a continuation of application Ser. No. 799,546, filed May 23, 1977.

BACKGROUND OF THE INVENTION

This invention relates to a magnetron, and more particularly to an improvement of the cathode structure of a magnetron.

Since magnetrons generate microwave energy at high efficiencies, they are incorporated in microwave ovens for cooking and defreezing foodstuffs. The cathode structures of the magnetrons are required to have long life, high quality and reliability.

As will be described later in more detail with reference to the accompanying drawings, a magnetron generally comprises a cathode structure disposed concentrically with a cylindrical anode. A prior art cathode structure of a magnetron comprises an upper end shield supported by a center support, a lower end shield supported by side supports, and a helical cathode filament concentric with the enter support, the upper end of the filament being secured to the upper end shield and the lower end to the lower end shield. The center support and the side supports are used as electrical lead wires for supplying heating current to the cathode filament from an external source.

Usually, the cathode filament is formed by helically winding a thorium-tungsten alloy wire having a diameter of about 0.6 mm. An assembly in which the cathode filament is connected to the upper and lower end shields is heated in an atmosphere of methane by passing electric current through the filament to form a carbide layer on the surface of the thorium-tungsten alloy wire which prevents evaporation of thorium having high emission property for thermoelectrons.

When a magnetron having a construction described above is incorporated into a microwave oven for heating and defreezing frozen foodstuffs, a relatively large filament current of, for example, 14 amperes at 3.15 volts is intermittently passed through the cathode filament for the purpose of controlling the oscillation output of the magnetron depending upon the type of the foodstuff and the method of cooking the same. For example, to defreeze frozen foodstuffs, the filament current is periodically intermitted. During the operation of a magnetron over a long time, the number of such intermittent control operations amounts to 200,000 to 300,000.

Under these operating conditions, cracks are formed in the surface of the carbide layer due to thermal stress so that the structure of the carbide layer becomes porous. This increases the area of the surface of the carbide layer and hence the heat dissipation by radiation with the result that the operating temperature of the filament decreases, thereby decreasing the number of thermionic emission from the filament. In an extreme case the magnetron becomes inoperative. For this reason, the life of the conventional cathode filament is 200,000 to 300,000 cycles when it is operated intermittently.

Moreover, the conventional cathode filament formed by helically winding a thorium-tungsten alloy wire has a small resistance against mechanical vibration and shock so that there is a fear of rupturing the relatively brittle carbide layer.

Considering the electrical characteristics, in the prior art cathode filament, since there is a relatively large gap between adjacent turns of the filament coil and accordingly there are many gaps along the axial length of the filament, the longitudinal contour of the filament becomes irregular and the irregular contour surface disturbs the electric field near the filament contour thereby rendering unstable the oscillation of the magnetron.

Moreover, the total length of coiled wire of the prior art cathode filament is comparatively large with the result that the cathode filament bears a relatively large impedance for microwaves and the microwave tends to couple with the cathode filament, thereby increasing radiation of unwanted electromagnetic waves. The large total length of thick filament results in a voluminous filament, thus requiring the filament to take long time for its warm up.

SUMMARY OF THE INVENTION

Accordingly, it is an object of this invention to provide a magnetron capable of greatly increasing the life of the cathode filament when it is operated intermittently.

Another object of this invention is to provide a magnetron having an improved cathode structure which can withstand against mechanical shocks and vibrations, does not rupture the carbide layer and has a high operating efficiency.

Still another object of this invention is to provide an improved magnetron capable of decreasing radiation of unwanted electric waves and stabilizing oscillation.

Still another object of this invention is to provide a magnetron having an improved cathode structure capable of increasing the warming up speed of cathode filament.

According to this invention, there is provided a magnetron of the type comprising a cathode structure and an anode structure surrounding the cathode structure, wherein the cathode structure comprises a filament, upper and lower end shields secured to the opposite ends of the filament for supporting the same, a center support and a side support respectively supporting the upper and lower end shields and also acting as electric leads, characterized in that the filament comprises a metallic cylindrical body provided with a plurality of openings.

The cylindrical body may take the form of a metallic cylinder, a cylindrical wire net formed by knitting metal wires or a cylindrical member formed by helically winding a perforated web of a metal sheet.

BRIEF DESCRIPTION OF THE DRAWINGS

Further objects, features and advantages of the invention can be more fully understood from the following detailed description taken in conjunction with the accompanying drawings in which:

FIGS. 5 through 8 including

DESCRIPTION OF THE PREFERRED EMBODIMENTS

Figure 1:
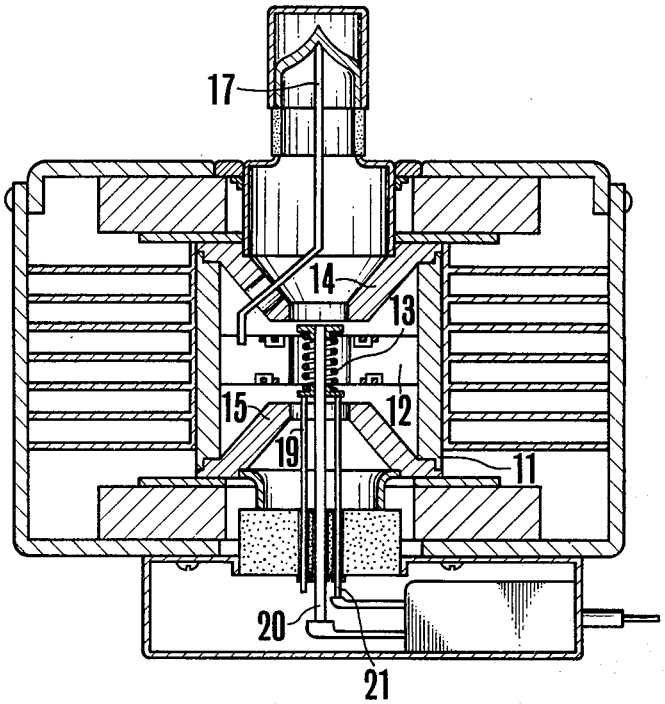
FIG.1 PRIOR ART
FIG. 1 is a longitudinal sectional view showing one example of a prior art magnetron.

At first a prior art magnetron shown in FIG. 1 and to which the invention is applicable will be described which comprises a cathode structure 13 and a cylindrical anode 11 surrounding the cathode structure and provided with a plurality of radial vanes 12. An upper pole piece 14 is provided on the upper end of the cylindrical anode 11 while a lower pole piece 15 is on the lower end. During the operation of the magnetron, the filament of the cathode structure is heated by current supplied via a center support 20 and a side support 21 for emitting thermoelectrons which are to be acted upon by the magnetic flux flowing between pole pieces 14 and 15 in an evacuated interaction space defined between the vanes 12 and the cathode structure 13. Accordingly, an oscillation is created and high frequency energy is transmitted to a utilization device through an antenna 17.

Figure 2:
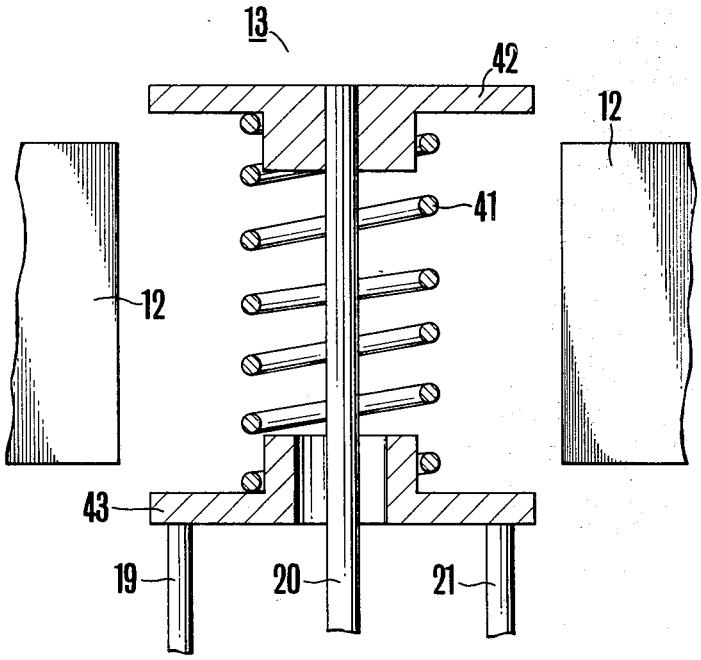
FIG.2 PRIOR ART
FIG. 2 is a longitudinal sectional view showing the cathode structure utilized in the magnetron shown in FIG. 1.

The main elements of the cathode structure 13 are shown in a longitudinal sectional view shown in FIG. 2. As shown, the cathode structure comprises a rod shaped center support 20 made of metal having a high melting point, a flange shaped upper end shield 42 also made of metal having a high melting point and brazed to the upper end of the center support 20, and a flange shaped lower end shield 43 made of the same material as the upper end shield. The lower end shield is spaced at a predetermined distance from the upper end shield and arranged concentrically with the center support which extends through a central opening of the lower end shield. Side supports 19 and 20 also made of metal having a high melting point are brazed to the opposite sides of the lower end shield 43 in symmetrical relationship with respect to the center support 20. Between the opposing surfaces of the upper and lower end shields 42 and 43 is disposed a filament 41 formed by helically winding a thorium-tungsten alloy wire having a diameter of about 0.6 mm and formed with a carbide layer on the upper surface. The opposite ends of the filament is secured to the upper and lower end shields as by brazing.

Figure 3A:
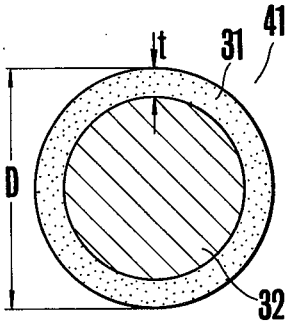
FIG.3 A PRIOR ART
FIG. 3A is a sectional view of the cathode filament of the cathode structure shown in FIG. 2.

The carbide layer designated by a reference numeral 31 in FIG. 3A is provided for the purpose of preventing evaporation of thorium having an excellent property of emitting thermoelectrons when it is heated. Usually, the carbide layer 31 contains tungusten carbide $W_2C$ which is formed by the reaction between the tungsten of the thorium-tungsten alloy and the carbon of methane atmosphere which is supplied to the heated filament which is heated to a temperature of about 2200° C. by electric current passed through the filament when the assembly of the filament and the upper and lower end shields is contained in an evacuated chamber. The filament wire has a diameter of D, and the central portion thereof is made of a thorium-tungsten alloy containing 0.5% to 2% by weight of thorium while the carbide layer 31 has a thickness t having a relation $t/D = 5\%$ to 15%.

Figure 3B:
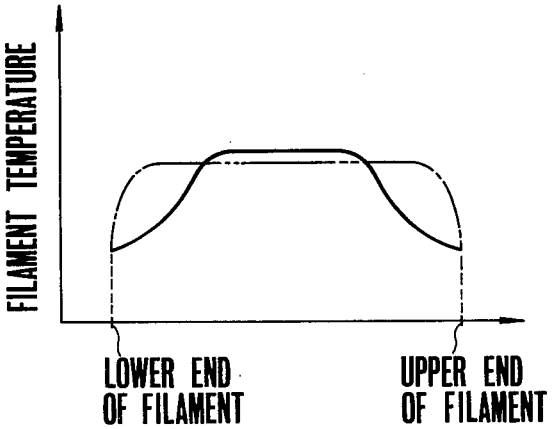
FIG.3 B PRIOR ART
FIG. 3B is a graph showing the temperature distribution of the cathode filament shown in FIG. 2.

The prior art filament is made of a relatively thick wire so that its resistance to heat conduction is relatively small. Consequently, the heat at the opposite ends of the filament is dissipated by conduction to the upper and lower end shields thus manifesting a temperature distribution along the filament as shown by a solid line shown in FIG. 3B in which the opposite ends of the distribution curve is lower than the central portion. For this reason, if one tries to form carbide layers having a suitable thickness also at the opposite ends of the filament, the thickness of the carbide at the central portion would be too large where the temperature is higher and the chemical reaction is severer than the opposite ends.

Considering the thermal stress created in a filament wire having a cross-sectional configuration as shown in FIG. 3A both the thorium-tungsten alloy wire 32 and the carbide layer 31 have temperature gradients in which the temperature increases from inside toward outer side so that the temperature difference between the surface of the carbide layer and the center of the filament wire is large, thus creating a large thermal stress on the surface of the carbide layer. Especially, as the carbide layer has smaller heat conductivity than the thorium-tungsten alloy wire, the temperature gradient between the inner and outer surfaces of the carbide layer is larger than that of the thorium-tangsten wire between its center and outer surface. Consequently, as the thickness of the carbide layer increases, the surface thermal stress becomes larger thus degrading (increased porosity) the carbide layer. To eliminate this difficulty, it is necessary to form a carbide layer having thin and uniform thickness along the whole length of the filament. Of course, it is desirable to make the thorium-tungsten wire to have a small diameter. To this end, it is necessary to construct the filament such that it will have a temperature distribution as shown by chained lines shown in FIG. 3B and to heat the filament to a suitable temperature. In order to obtain the temperature distribution shown by the chained lines, it is necessary to make thin the filament wire to increase its resistance to heat conduction thus limiting dissipation by conduction from the opposite ends. However, when the diameter of the filament wire wound in a helical form is reduced, the resistance of the filamant against external shocks and vibration will be reduced.

The object of this invention lies in the solution of this problem.

Figure 4:
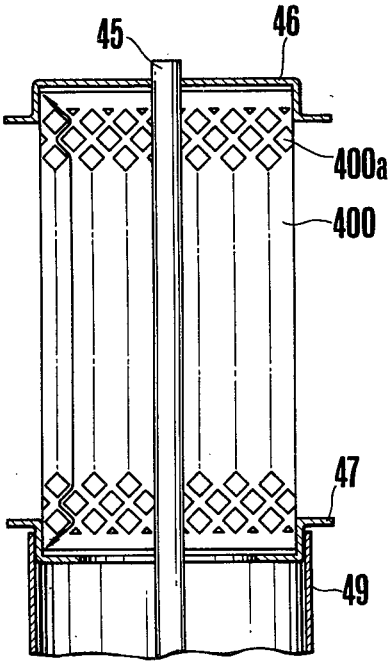
FIG. 4 is a longitudinal sectional view showing one embodiment of the magnetron cathode structure according to the invention.

FIG. 4 shows one embodiment of the magnetron cathode structure constructed in accordance with this invention. As shown, a cup shaped upper end shield 46 made of molybdenum or tungsten is brazed to the upper end of a rod shaped center support 45 made of electrocoductive metal. A lower end shield 47 made of the same material as the upper end shield is located at a position spaced a predetermined distance from the upper end shield concentrically with respect to the center support 45. The center support extends through an opening of the lower end shield whereby these members are electrically insulated. The opposite sides of the lower end shield are brazed to a cylindrical side support 49 made of molybdenum or the like. A cathode filament 400 comprising a cylinder made of a thorium-tungusten alloy is interposed between the upper and lower end shields 46 and 47. The cylinder is provided with a plurality of diamond shaped openings 400*a* which are formed by etching. The opposite ends of the cathode filament 400 are received in the recesses of the end shields and secured thereto by brazing.

Figure 5:
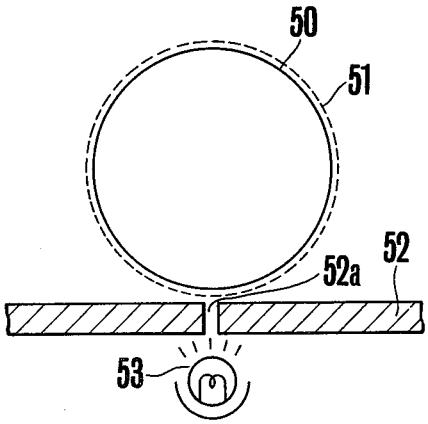
Figure 9:
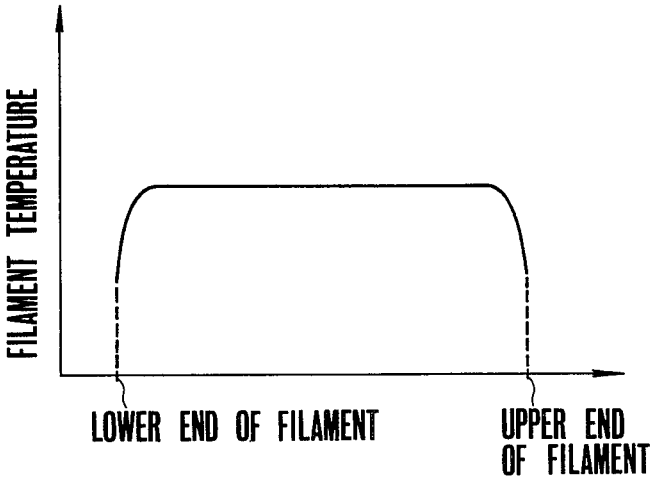
FIG. 9 is a graph showing the temperature distribution of a cathode filament embodying the invention.

Such cathode filament can be manufactured, as shown in FIG. 5, by applying a photoresist the outer surface of a cylinder having a relatively thin wall thickness of about 0.1 mm and made of a thorium-tungsten alloy, covering the photoresist layer with a screen 51 having diamond shaped perforations, and projecting light from a light source 53 upon the photoresist layer through a slit 52*a* formed through a light shield 52. The cylinder 50 is rotated to expose to light a plurality of diamond shaped portions of the photoresist layer. Such exposed portions of the photoresist layer are etched off thereby obtaining the cylindrical cathode filament 400 provided with a plurality of the diamond shaped openings 400*a*. Advantageously, these openings are aligned in the axial direction of the filament for the purpose of controlling the flow of the filament current. In the example shown in FIG. 4 diamond shaped openings of adjacent rows are staggered. Consequently, the current flows through tortuous passages as shown by an arrow shown in FIG. 4. Since the filament comprises a relatively thin cylinder, each current path can be considered as a relatively fine conductor. For this reason, it is possible to limit the heat dissipation from the upper and lower ends of the filament where the resistance to heat conduction is large. Consequently, when electric current is passed through the filament, a temperature distribution as shown in FIG. 9 can be obtained. This means that by passing a suitable constant current, it is possible to uniformly form a carbide layer ($W_2C$) having a relatively small thickness (for example, about 10 $\mu$m) along the entire length of the filament. Consequently, it is possible to prevent degradation of the filament and hence to improve its life. Since the filament has a form of a cylinder its mechanical strength is high. Furthermore, the use of the thin wall thickness reduces the irregularity of the surface of the filament and the surface becomes smooth, so that disturbance of electric field near the surface of the filament can be reduced, thereby stabilizing the oscillation of the magnetron.

The cathode structure of the invention is advantageous over the prior art cathode structure in that the warming up speed is increased and the impedance for microwaves is decreased. Comparison will be made between the present invention and the prior art under the conditions that the distance between upper and lower end shields, filament voltage and current, and area of the thermoelectron emitting surface are the same for both the cases. The total length of coiled wire of the prior art cathode filament is far larger the height of the cylinder constituting the cathode filament of this invention with the result that the prior art cathode filament bears a larger impedance for microwaves and the microwave tends to couple with the cathode filament, thereby increasing radiation of unwanted electromagnetic waves. Obviously, because of the large total length of thick wire coil filament, the prior art cathode filament results in a voluminous filament, thus requiring the filament to take a long time for its warm-up.

Moreover, as the filament comprises a cylinder made of a thorium-tungsten alloy which is provided with a plurality of aligned diamond shaped openings, the outer diameter of the cylinder can be maintained at a constant value and the handling of the filament is easy. Such cylindrical filament can readily be received in the recesses of the upper and lower end shields and can readily be brazed to the shields. Moreover, the diamond shaped openings can readily be formed by photoetching technique described above. This technique permits mass production of the filament at a reduced cost.

Figure 6:
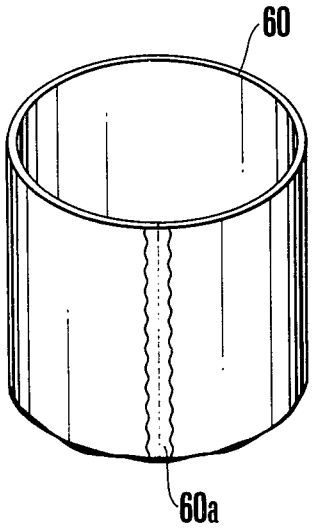

In a modified embodiment shown in FIG. 6 the filament cylinder 60 is formed by deforming a sheet of a thorium-tungsten alloy into a cylinder and the abutting side edges are welded as at 60*a*. Thereafter, diamond shaped openings 400*a* are formed by photoetching technique in the same manner as above described.

Figure 7A:
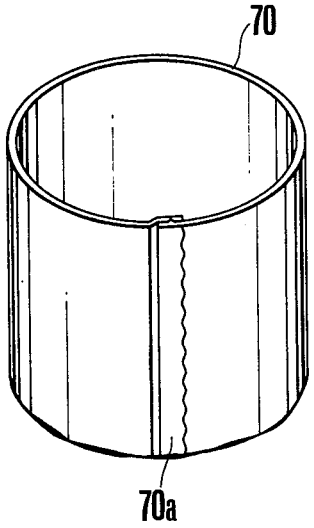
FIGS. 7A and 7B are views for explaining a method of manufacturing the cathode structure shown in FIG. 4.
Figure 7B:
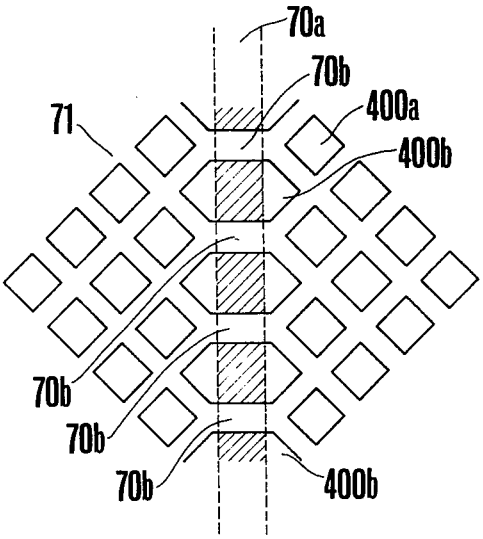

FIGS. 7A and 7B show another method of manufacturing a cylindrical filament. In this case, the side edges of a rounded sheet of the thorium-tungsten alloy are overlapped and then welded as at 70*a* to obtain a cylinder 70. Since it is difficult to uniformly form diamond shaped openings 400*a* at the overlapped portion by photoetching, the temperature of this portion decreases during the operation of the magnetron thus causing deformation of the filament. To obviate this difficulty, hexagonal openings 400*b* are formed at the weld 70*a* as shown in FIG. 7B by photoetching. Since the weld 70*a* is thicker than the other portions of the cylinder, it takes a longer etching time. To overcome this difficulty, a mask having a smaller size than the finished dimension is applied to the openings 400*a* whereas a mask having the finished dimension is applied to the weld. After photoetching, the mask for the openings 400*a* is changed to a mask having the finished dimension so as to obtain openings 400*a* having the finished dimension concurrently with the formation of shaded perforations through the weld as shown in FIG. 7B. Not etched portions of the welds form bridges 70*b* which interconnect the portions of the cylinder on the opposite sides of the weld. With this construction, filament current does not flow through teh bridges 70*b* because the potentials on the opposite sides of each bridge are equal so that overall current distribution would not be disturbed. Accordingly, there is no deformation of the cylinder at these portions thus assuring satisfactory oscillation.

Figure 8:
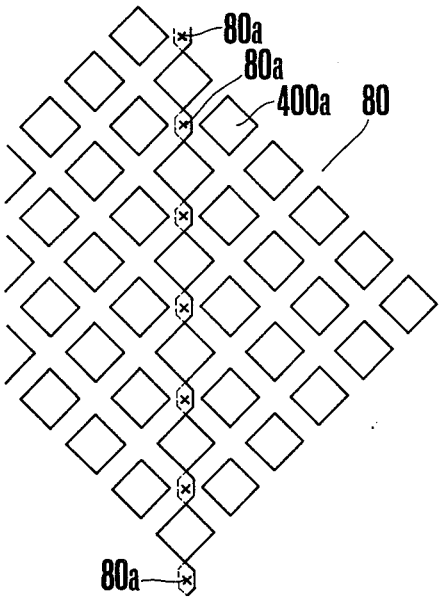

FIG. 8 shows another example of the method of manufacturing the cylindrical cathode filament of this invention. At first, a plurality of diamond shaped openings 400*a* are formed through a sheet of a thorium-tungsten alloy by photoetching technique, pressing, electric discharge, raser beam or electron beam working. Then, the perforated sheet is rounded and the overlapped side edges are welded together to form a cylindrical filament 80. The perforated sheet is cut such that its side edges come to portions 80*a* at which "wire nets" remaining after forming the openings 400*a* cross each other. Then the side edges are overlapped at these portions 80*a* and then spot welded. Since spot welds form low resistance connection, they do not disturb the distribution of the current flowing through the wire nets. Moreover, as the thickness of the metal sheet is small, the overlapped portions do not appreciably affect the mechanical balance of the cylinder as well as the true circular configuration thereof. This construction also does not cause any deformation of the cylinder so that it can assure excellent oscillation.

It should be understood that the configuration of the openings of the filament cylinder is not limited to diamond shape, and that they may be circular, elliptical, or polygonal.

It is also appreciated that the upper and lower end shields may take the same configuration as the prior art ones and that the side support may be formed into a rod as in the prior art.

Figure 10A:
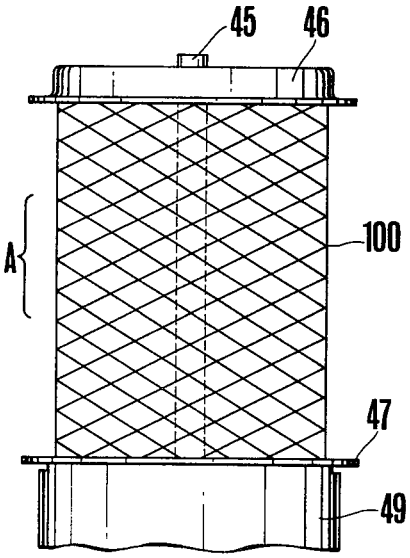
FIG. 10A is a side view showing a modified embodiment of the magnetron cathode structure according to the invention.
Figure 10B:
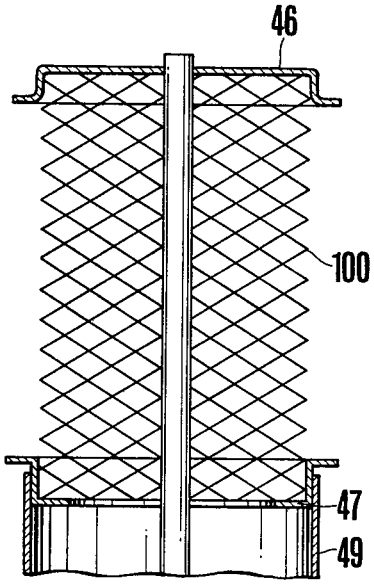
FIG. 10B is a longitudinal sectional view of the cathode structure shown in FIG. 10A.
Figure 10C:
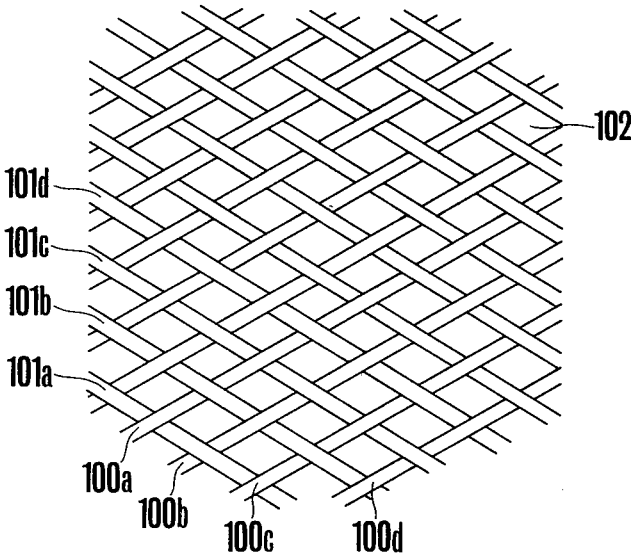
FIG. 10C is an enlarged view of portion of one example of the filament utilized in the cathode structure shown in FIG. 10A.

Further, it is also possible to form the filament cylinder by knitting relatively thin thorium-tungsten alloy wires having a diameter of about 0.15 mm, as shown in FIGS. 10A, 10B and 10C in which portions corresponding to those shown in previous embodiments are designated by the same reference charactors. A cylindrical filament 100 is formed by helically knitting in opposite directions thorium-tungsten alloy wires having a diameter smaller than conventional wires. The opposite ends of the cylindrical filament 100 are received in and soldered to the recesses of the upper and lower end shields 46 and 47. A portion of the knitted filament is shown in FIG. 10C. As shown, clockwise wires 100*a* through 100*d* and counterclockwise wires 101*a* through 101*d* are knitted to form a wire net having openings 102 of proper size. Since the outer dimension of the wire net filament is maintained accurately, it is not necessary to weld crossing wires. Moreover, the wire net filament is suitable for mass production.

Figure 11:
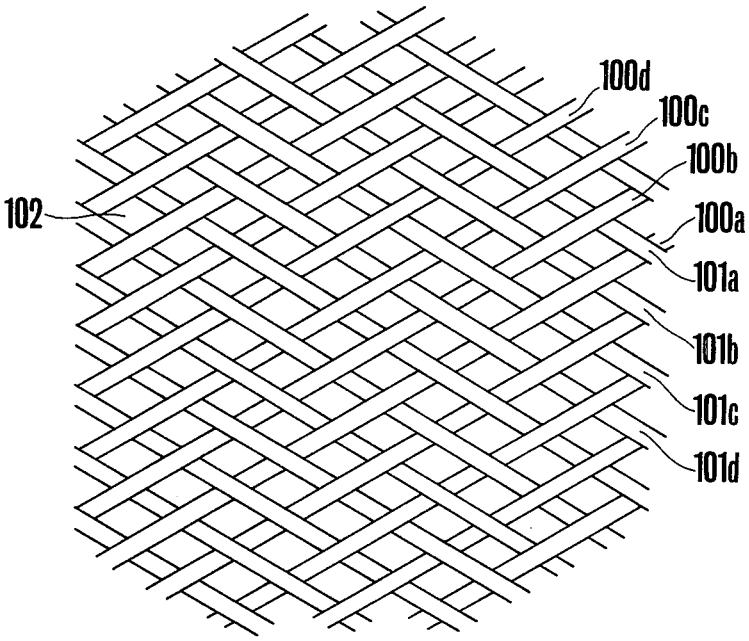
FIG. 11 is an enlarged view of a portion of another example of the filament of the cathode structure shown in FIG. 10A.

The modified wire net filament shown in FIG. 11 is different from that shown in FIG. 10C in that each pairs of clockwise wires 100*a* through 100*d* and each pairs of counterclockwise wires 101*a* through 101*d* are alternately knitted to form a wire net having openings 102 of suitable size. Since a pair of clockwise wires and a pair of counterclockwise wires are alternately knitted, the wire net can be manufactured readily and at high speed which is suitable for mass production. If the outer surface of the wire net filament deforms, several crossing points of the wires may be welded.

The wire net filament described above is manufactured as follows. A cylinder having the same outer diameter as the inner diameter of the upper and lower end shields and having a suitable length is used as a core and pairs of clockwise wires and counterclockwise wires are alternately wrapped about the core to form a knitted filament. An organic binder such as acryl resin or nitrocellulose is applied to each crossing point of the wires or to spaced crossing points to bond the wires. Application of the organic binder is to prevent deformation of the knitted filament when it is dismounted from the core. After knitting, the knitted cylindrical filament is dismounted from the core and then cut to have a definite length. Alternatively, the knitted filament mounted on the core is cut to the definite length or cut together with the core and then the knitted filament is dismounted from the core. When the knitted filament is secured to the upper and lower shields by brazing as described above, the organic binder applied to the crossing points of the wires tends to splash thereby deforming the wire net. However, as the end portions of the wire net filament are held by the inner peripheries of the end shields, such deformation does not occur actually.

During the brazing operation, the central portion (A) of the wire net filament shown in FIG. 10A may be clamped by a suitable jig, not shown. Alternatively, the crossing points at such portion may be welded to improve the dimensional accuracy of the diameter of the filament.

Figure 12A:
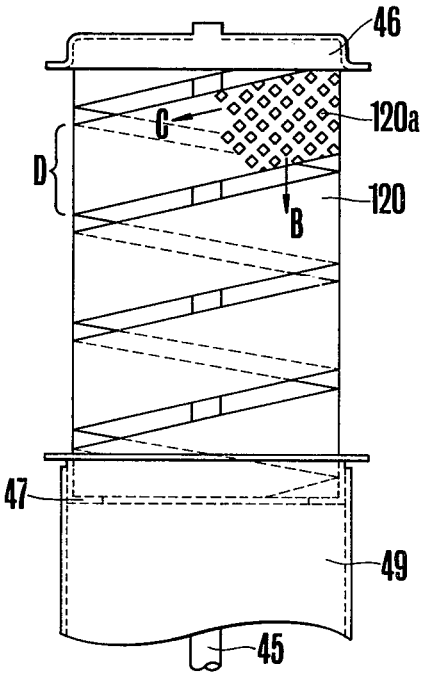
FIG. 12A is a front view of still another embodiment of the magnetron cathode structure according to the invention.
Figure 12B:
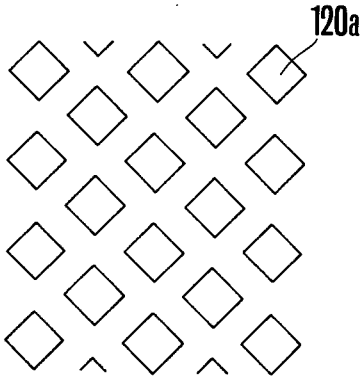
FIG. 12B is an enlarged view of a portion of the filament utilized in the cathode structure shown in FIG. 12A.

FIGS. 12A and 12B show still another embodiment of this invention in which a cylindrical filament 120 is formed by helically winding a relatively thin (about 0.1 mm) web of a sheet of a thorium-tungsten alloy and formed with a plurality of openings 120*a*. The filament is then soldered to the upper and lower end shields 46 and 47. As shown by a magnified view shown in FIG. 12B, the openings 120*a* are provided for the web by pressing to increase the electrical resistance of the web thus increasing the amount of heat generated by the filament. As shown by arrow B shown in FIG. 12A, the openings 120*a* are aligned in the axial direction of the filament but slightly inclined with respect to the width of the web as shown by arrow C. By arranging the openings in the direction B at least for the width of the web, it is possible to prevent the web from being twisted at the time that the web is wound helically. Arrangement of the openings in the direction C assures suitable current path.

The modified filament shown in FIG. 12A can increase the electrical resistance since the filament is prepared by helically winding a perforated web. In other words, it is possible to decrease filament current for a definite filament voltage. This makes easy the design of the filament transformer. Since the current is small, the reliability of the connection between the filament and the source as well as the noise eliminating filter can be improved.

Figure 13A:
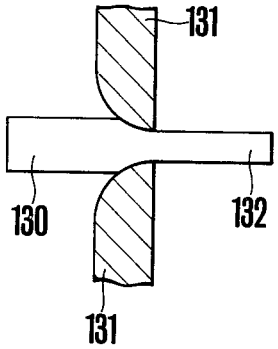
FIGS. 13A, 13B, 13C and 13D are schematic representions showing various steps of manufacturing the cathode structure shown in FIG. 12A.
Figure 13B:
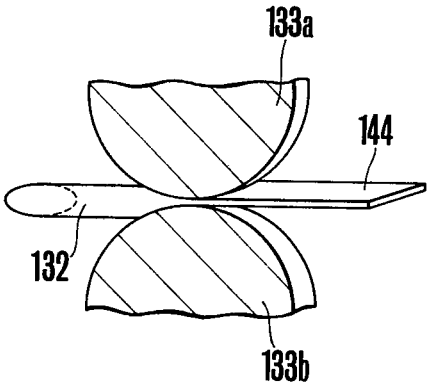
Figure 13C:
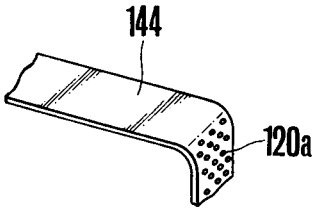
Figure 13D:
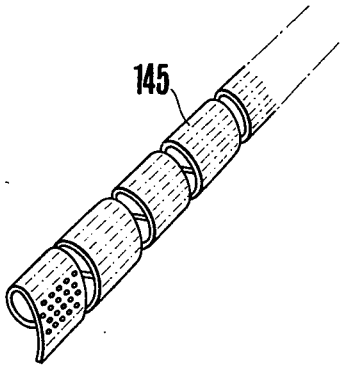

The modified filament shown in FIG. 12A is manufactured as follows. A rod 130 of a thorium-tungsten alloy is passed though a die 131 (FIG. 13A) to form a wire 132 having an elliptical cross-section, which is then rolled into a web 144 by a pair of rolls 133*a*, 133*b*, as shown in FIG. 13B. Then a plurality of diamond shaped openings 120*a* is provided for the web by a press work. Then, the perforated web is helically wound about a core and then annealed as shown in FIG. 13D. After removing the core the helically wound web is cut to a definite length to obtain filaments.

What is claimed is:

1. In a magnetron of the type including a cathode structure and an anode structure surrounding the cathode structure, wherein said cathode structure includes a filament, upper and lower end shields secured to the opposite ends of the filament for supporting the same, and a center support and a side support respectively supporting said upper and lower end shields and also acting as electric leads, the improvement comprising:

a filament in the form of a metallic cylindrical body provided with a plurality of openings therethrough;

said upper and lower end shields further including upper and lower cylindrical cups having the openings thereof facing each other for receiving the cylindrical filament and wherein the opposite ends of the cylindrical filament are contained within and supported by the cylindrical cups.

2. The magnetron according to claim 1 wherein said cylindrical body comprises a single metal cylinder.

3. The magnetron according to claim 1 wherein said cylindrical body is formed by first bending a metal sheet into a cylindrical shape and then etching said plurality of openings therethrough.

4. The magnetron according to claim 1 wherein said cylindrical body comprises a knitting of metal wires and wherein opposite ends of said knitting of metal wires are respectively contained within said upper and lower cylindrical cups so as to maintain the dimensional stability of said cylindrical body.

5. The magnetron according to claim 1 wherein said cylindrical body comprises a metal web provided with a plurality of perforations and helically wound into the cylindrical body.

6. The magnetron according to claim 5 wherein said perforations are arranged in such a pattern to control the direction of flow of the current flowing through said cylindrical body.

7. The magnetron according to claim 5 wherein said perforations are arranged in parallel with the axis of said cylindrical body within the width of said web.

8. The magnetron according to claim 4 wherein the opposite ends of said knitting of metal wires are respectively welded to the inside cylindrical walls of said upper and lower cylindrical cups.

9. The magnetron according to claim 8 wherein said knitting of metal wires includes a plurality of individual metal wires which are interwoven but not otherwise attached to one another outside of said upper and lower cylindrical cups.

10. The magnetron of claim 5 wherein the metal web is formed of perforated metal strip having a width substantially greater than the thickness thereof and having a length greater than the width thereof.

11. The magnetron of claim 10 wherein the dimensions of the perforations exceed the thickness of the strip and are less than the width of the strip.

12. In a magnetron of the type including a cathode structure and an anode structure surrounding the cathode structure, wherein said cathode structure includes a filament, upper and lower end shields secured to the opposite ends of the filament for supporting the same, and a center support and a side support respectively supporting said upper and lower end shields and also acting as electric leads, the improvement comprising:

a filament in the form of a metallic ribbon helically wound to form a cylindrical body with the ends of said ribbon connected to said end shields to define a helical current path therebetween, said web being perforated with a pattern of openings to reduce the cross-section of the ribbon as a current conductor while maintaining its overall area outline as an electron emitter.

13. The magnetron of claim 12 wherein the metal web is formed of perforated metal strip having a width substantially greater than the thickness thereof and having a length greater than the width thereof.

14. The magnetron according to claim 13 or 14 wherein said perforations are arranged in such a pattern to control the direction of flow of the current flowing through said cylindrical body.

15. The magnetron according to claim 14 wherein said perforations are arranged in parallel with the axis of said cylindrical body within the width of said web.

* * * * *

UNITED STATES PATENT AND TRADEMARK OFFICE

CERTIFICATE OF CORRECTION

PATENT NO. : 4, 230, 968
DATED : Oct. 28, 1980
INVENTOR(S) : Tomokatsu Oguro

It is certified that error appears in the above—identified patent and that said Letters Patent is hereby corrected as shown below:

col.3, line 4: delete "including figs. 7a and 7b"

col. 10, line 27: change "13 or 14" to--12 or 13--

Signed and Sealed this

*Fifteenth* Day of *December 1981*

|SEAL|

*Attest:*

GERALD J. MOSSINGHOFF

*Attesting Officer*

*Commissioner of Patents and Trademarks*